US007931215B2

(12) United States Patent
Callendret et al.

(10) Patent No.: US 7,931,215 B2
(45) Date of Patent: Apr. 26, 2011

(54) DEVICE AND AN INSTALLATION FOR SPRAYING A COATING FLUID, AND INCLUDING A RESERVOIR

(75) Inventors: Samuel Callendret, Grenoble (FR); Patrick Ballu, Reims (FR)

(73) Assignee: Sames Technologies, Meylan (FR)

( * ) Notice: Subject to any disclaimer, the term of this patent is extended or adjusted under 35 U.S.C. 154(b) by 639 days.

(21) Appl. No.: 11/993,769

(22) PCT Filed: Jun. 22, 2006

(86) PCT No.: PCT/FR2006/001429

§ 371 (c)(1),
(2), (4) Date: Dec. 21, 2007

(87) PCT Pub. No.: WO2006/136717

PCT Pub. Date: Dec. 28, 2006

(65) Prior Publication Data

US 2010/0116905 A1 May 13, 2010

(30) Foreign Application Priority Data

Jun. 23, 2005 (FR) ..... 05 06390

(51) Int. Cl.
*B05B 11/02* (2006.01)

(52) U.S. Cl. ..... 239/320; 239/302

(58) Field of Classification Search ..... 239/380, 239/302, 333, 337, 349, 355, 357, 569, 581.1, 239/320

See application file for complete search history.

(56) References Cited

U.S. PATENT DOCUMENTS

| | | | | |
|---|---|---|---|---|
| 2,001,819 | A * | 5/1935 | Eugen Elle et al. | 222/143 |
| 2,880,939 | A * | 4/1959 | Esmay | 239/331 |
| 4,175,704 | A * | 11/1979 | Cohen | 239/320 |
| 4,344,573 | A * | 8/1982 | De Felice | 239/320 |
| 5,372,311 | A * | 12/1994 | Nye | 239/320 |
| 2003/0234299 | A1 | 12/2003 | Hosoda et al. | |

FOREIGN PATENT DOCUMENTS

| | | | |
|---|---|---|---|
| EP | 0587467 | A1 | 8/1993 |
| GB | 2319737 | A1 | 6/1998 |
| GB | 2414693 | A | 12/2005 |
| WO | 2004082847 | A1 | 9/2004 |

* cited by examiner

*Primary Examiner* — Davis Hwu
(74) *Attorney, Agent, or Firm* — Robert M. Gould; Duane Morris LLP

(57) ABSTRACT

This device comprises a sprayer (10) and a reservoir (9) for feeding the sprayer with fluid. The reservoir (9) defines a cylindrical housing (L9) in which there slides (F1) a piston (91) forming a moving wall (91*a*) for a storage volume (V9) for storing the coating fluid. The housing (L9) is defined by a jacket (92) placed in a support-forming body (95). The jacket (92) has an end wall (93) co-operating with the peripheral wall (96) of the jacket (92) and with the piston (91), to define the above-mentioned storage volume (V9). No interstice are present in which the coating fluid could accumulate, thereby making the reservoir (9) easier to clean.

12 Claims, 4 Drawing Sheets

DEVICE AND AN INSTALLATION FOR SPRAYING A COATING FLUID, AND INCLUDING A RESERVOIR

The present invention relates to a device for spraying a coating fluid, the device including a reservoir for feeding a sprayer with fluid, and the invention also relates to an installation for spraying a coating fluid and that includes such a device, amongst other things.

In the field of spraying a coating fluid, it is known to use one or more reservoirs having pistons for feeding the sprayer or sprayers of an installation with fluid. Depending on the pressure exerted by the piston in each reservoir on the fluid that is to be found therein, the coating fluid is delivered to the sprayer(s) at a rate and at a pressure that are under control. EP-A-0 587 467 discloses mounting such a reservoir on the moving portion of a multi-axis robot close to a sprayer and fitting it with a cylindrical jacket within which there slides the piston that is moved under control to expel a coating fluid to a sprayer. The function of the jacket is to improve the sliding conditions for the piston, and the jacket is supported by the body of the reservoir. It is difficult to clean the end wall of the reservoir, i.e. its zone into which there open out ducts that are connected to the sprayer and to sources of fluid, because interstices can exist between the jacket and said end zone, where such interstices tend to have coating fluid accumulate therein. Now, it is often necessary to change the spraying fluid, e.g. in an installation for spraying coating fluids on motor vehicle bodywork. There thus exists a risk of one coating fluid becoming polluted by another.

In addition, a gasket generally needs to be provided in the vicinity of the end wall of the reservoir in order to receive the edge of the jacket bearing thereagainst, said gasket being subjected to physical or chemical attack as a result of coming into contact with the various coating fluids and the cleaning fluid(s). The presence of such a gasket makes maintenance operations complex since they require the sprayer device concerned to be dismantled completely. While the reservoir is being filled with coating fluid, the fluid that penetrates into the reservoir strikes the front face of the piston, thereby tending to move the piston away from the end wall of the reservoir, and to entrain the jacket away from the end wall by adhesion. The fluid that may be injected into the reservoir under pressure, also tends to deform the reservoir body by moving its end wall away from the jacket. Thus, the forces due to the fluid tend to move the jacket away from the end wall of the reservoir, thereby leaving an empty space in which the fluid can accumulate in the vicinity of the gasket. After filling and while the fluid contained in the reservoir is being used, the jacket and the end wall return to their nominal configuration and some quantity of fluid can remain trapped in the vicinity of the gasket, ready to pollute a second coating fluid introduced on the subsequent occasion the reservoir is filled, since this trapped quantity will be released when the reservoir is filled with the second fluid, because of the forces exerted by the second fluid.

The invention seeks more particularly to remedy those drawbacks by proposing a novel sprayer device that includes a reservoir in which the coating fluid storage volume can be cleaned in reliable and complete manner, and in which maintenance is simplified compared with known equipments.

To this end, the invention relates to a device for spraying a coating fluid, the device comprising a sprayer together with a reservoir for feeding the sprayer with fluid, this reservoir comprising a body and defining a cylindrical housing in which there slides a piston forming a moving wall for a storage volume for storing the coating fluid, this housing being defined by a jacket disposed in said body that forms a support for the jacket. The device is characterized in that the jacket is provided with an end wall that co-operates with the peripheral wall of the jacket and with the above-mentioned piston to define the coating fluid storage volume.

Thanks to the invention, the end wall and the adjacent portion of the peripheral wall of the jacket together define a continuous surface that defines with the piston, the variable volume for storing the coating fluid. No interstice is created in which the coating fluid could accumulate, thereby facilitating cleaning operations. In addition, there is no need for a gasket, thereby simplifying assembly and reducing the maintenance operations required when using the device. The invention goes against a prejudice of the person skilled in the art who used, until now, to consider that using a jacket provided with an end wall would make the operations of removing the reservoir more difficult whenever it is necessary to remove the piston from its housing, in particular for the purpose of inspecting its front face or its piston rings. In addition, the forces that result from the pressure of the coating fluid during filling have the effect of pressing the end wall of the jacket against the body of the reservoir, without any risk of leakage, fluid accumulation, or contamination with a second fluid.

The invention stems from an approach opposite to that envisaged in WO-A-2004/082847, for example, in which a body is used that does not have a jacket, thus preventing the use of a material that is selected mainly for its properties of sliding in association with the piston, since the function of the body is above all to provide mechanical protection and the ability to withstand pressure.

According to advantageous but non-essential aspects of the invention, such a device may incorporate one or more of the characteristics of claims 2 to 8.

The invention also relates to an installation for spraying a coating fluid, which installation includes at least one sprayer device as described above.

Advantageously, the installation also includes at least one appliance for removing the piston in place in the above-specified housing, the appliance having means enabling a pressure difference to be generated between the pressures that exist respectively in the coating fluid storage volume and in another volume formed in the above-mentioned housing and separated from the storage volume by the piston, this pressure difference being such that the pressure existing in the storage volume is greater than the pressure existing in the other volume, when there is no fluid for storage in said volumes.

In a first embodiment, the removal appliance comprises:

a body suitable for being fitted in leaktight manner on the jacket or an element secured to the jacket, the body defining an open volume suitable for being put into communication with the housing; and a suction device suitable for creating relative vacuum pressure in this volume, when the above-mentioned body is fitted on the jacket or the element secured thereto.

Provision can be made for the body of the appliance to be blind and for the suction device to be of the Venturi effect type and integrated in the end wall of the body.

In another embodiment, the removal appliance includes means for injecting a fluid other than the fluid to be stored, under a pressure that is greater than atmospheric pressure, into the storage volume for storing the coating fluid.

The invention can be better understood and other advantages thereof appear more clearly in the light of the following description of a sprayer device in accordance with the invention and of an installation for spraying a coating fluid in accordance with the invention, given solely by way of example and made with reference to the accompanying drawings, in which.

Figure 1:
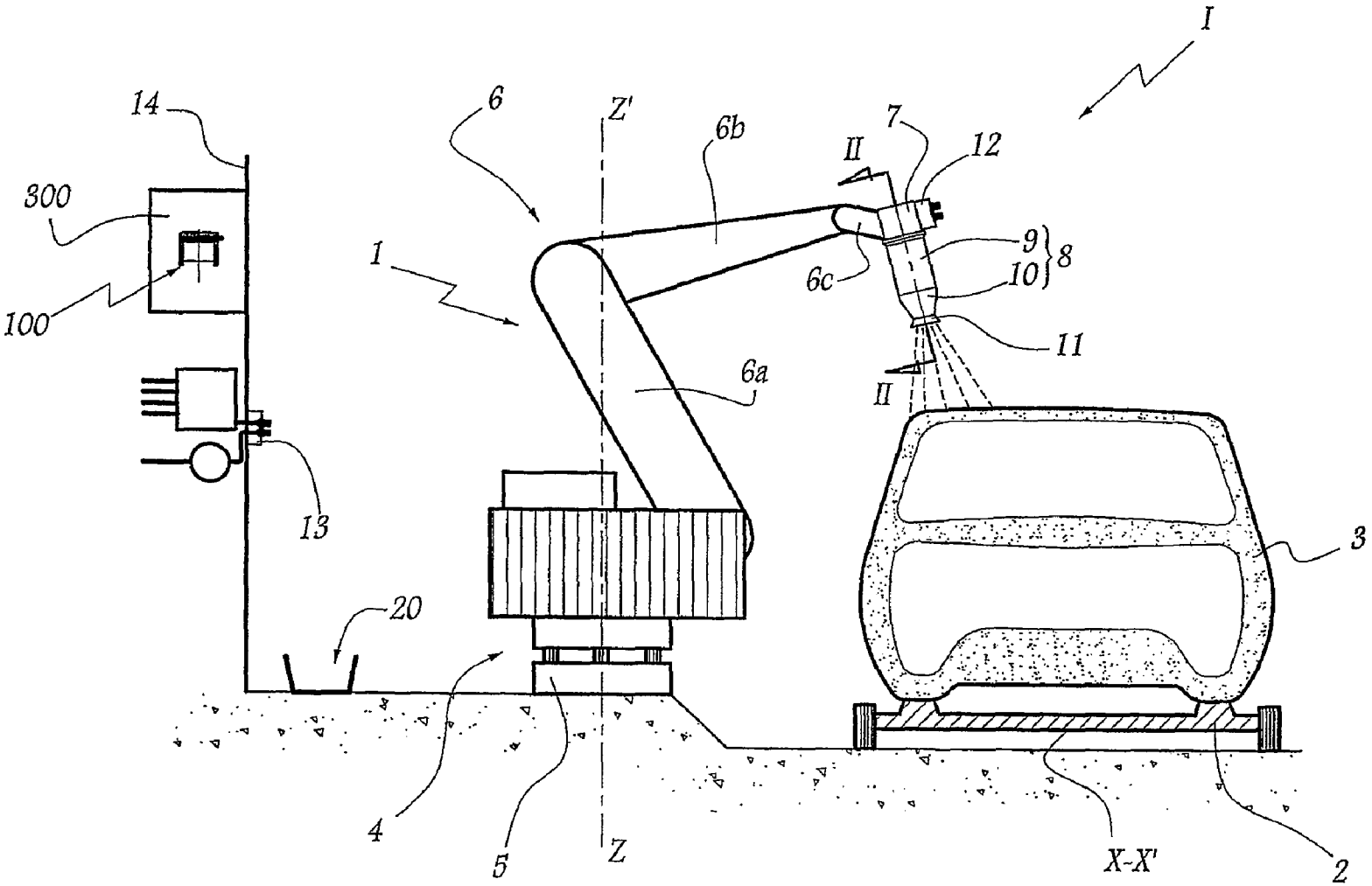
FIG. 1 is a diagrammatic sketch view of an installation for spraying a coating fluid in accordance with the invention and incorporating a device in accordance with the invention.

In the installation I shown in FIG. 1, an automat or robot 1 is placed close to a conveyor 2 transporting articles for coating, specifically bodywork portions 3 for motor vehicles. The robot 1 is of the multi-axis type and comprises a chassis 4 mounted to move on a guide 5 that extends parallel to the direction X-X' in which bodywork portions 3 are conveyed. An arm 6 is supported by the chassis 4 and comprises a plurality of segments 6*a*, 6*b*, 6*c* that are hinged relative to one another. The chassis 4 can perform swiveling movements about an axis Z-Z' that is essentially vertical.

The end segment 6*c* of the arm 6 carries a plate 7 having a sprayer device 8 removably mounted thereon by means of a nut 71, the sprayer device 8 comprising a reservoir 9 of coating fluid and a sprayer 10 of rotary type fitted with a rotating bowl 11.

As envisaged in EP-A-0 274 322, connection means 12 and 13 are provided respectively on the plate 7 and on a stationary portion 14 of the installation I to enable the reservoir 8 to be cleaned and filled periodically.

Figure 2:
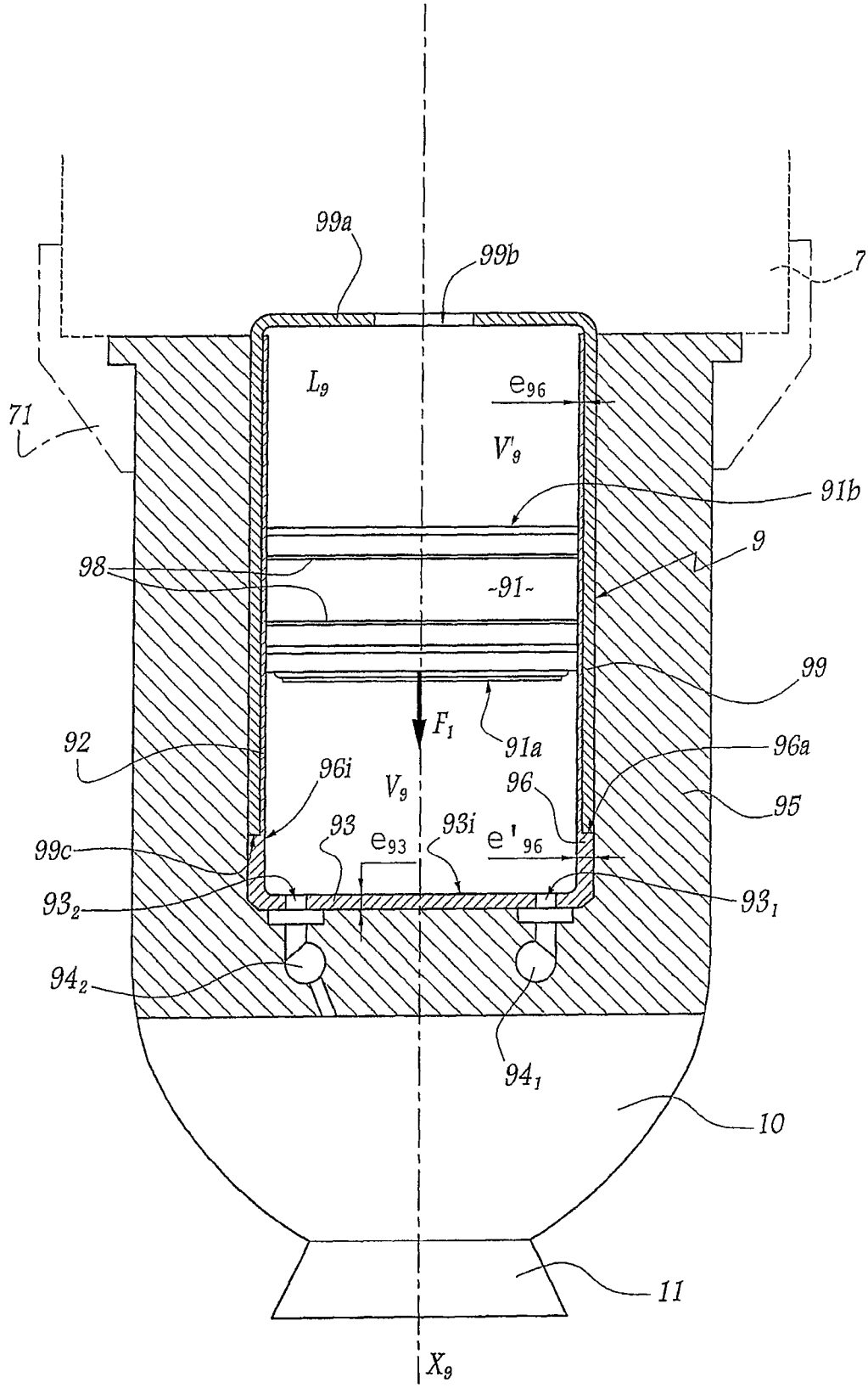
FIG. 2 is a fragmentary diagrammatic section on line II of FIG. 1.

As can be seen more particularly in FIG. 2, the reservoir 9 defines a cylindrical housing L9 in which there is disposed a piston 91 shown in outside view in the figures and capable of sliding parallel to the direction of a central axis $X_9$ of the housing $L_9$. The housing $L_9$ may be circular in section or of some other shape.

The housing $L_9$ is defined by a jacket 92 that is closed at one end with its end wall being referenced 93. Because of the presence of the end wall 93, the jacket 92 can be said to be "blind". A first duct $\mathbf{94}_1$ connects the connection means 12 to the housing $L_9$ via an orifice $\mathbf{93}_1$ formed through the end wall 93. A second duct $\mathbf{94}_2$ connects the housing $L_9$ to the sprayer 10, which is shown in outside view in FIG. 2. An orifice $\mathbf{93}_2$ is provided in the end wall 93. The ducts $\mathbf{94}_1$ and $\mathbf{94}_2$ open out in register with the orifices $\mathbf{93}_1$ and $\mathbf{93}_2$. The duct $\mathbf{94}_2$ enables the sprayer 10 to be fed with coating fluid when the piston 91 is moved towards the end wall 93 in the direction of arrow $F_1$ in FIG. 2.

The jacket 92 is made of a single piece. It may be made by upsetting and then machining a metal, or by flow turning followed by machining. It may also be made from two parts that are united to form a single unseparable part. These two parts, namely a cylindrical sleeve and an end wall, may be assembled together by screw-fastening or by welding, with sealing subsequently being ensured prior to making the assembly secure by means of a needle, a nut, or adhesive, with the junction zone being re-machined for finishing purposes.

The jacket 92 is received in a body 95 of the reservoir 9 which forms a support for the jacket. The body 95 has a structural function of withstanding the pressure that exists within the housing $L_9$, and a function of mechanically protecting the jacket 92 that it surrounds. In contrast, the jacket 92 seeks mainly to facilitate movement of the piston 91 in translation and to contain the fluid for spraying. It may be made of a suitable material without any particular precautions being taken on the topic of its mechanical strength since it is supported by the body 95. Various non shown ducts are provided in the body 95 for feeding the sprayer 10.

V9 denotes the volume situated between the front face 91*a* of the piston 91 and the end wall 93. The piston 91 is fitted with rings 98 enabling the volume $V_9$ to be isolated from a volume $V_9$ situated in the housing $L_9$ opposite from the volume $V_9$, i.e. between the rear face 91*b* of the piston 91 and the opening $\mathbf{0}_{92}$ of the jacket 92 through which the piston 91 can be put into place in the housing L9.

Thus, the volume V9 in which the coating fluid for feeding to the sprayer 10 is stored temporarily is itself defined between the piston 91, the peripheral wall 96 of the jacket 92 and the end wall 93 of the jacket. Since the jacket 92 is a single piece, the inside surface 96*i* of the wall 96 and the inside surface 93*i* of the end wall 93 meet each other without discontinuity and without creating any interstices that could retain residues of the coating fluid between two stages of spraying.

At the end of a spraying operation, i.e. when the piston 91 has traveled in the direction of arrow $F_1$ until its front face 91*a* is in the immediate vicinity of the surface 93*i*, a predetermined quantity of cleaning fluid can be injected into the volume $V_9$, which is then of small capacity, in order to clean not only the surfaces 91*a* and 93*i*, but also the portion of the surface 96*i* that has not been scraped by the rings 98. The cleaning fluid is injected via the duct $\mathbf{94}_1$ and the orifice $\mathbf{93}_1$, with the cleaning fluid being evacuated to the ducts internal to the sprayer 10 in order to clean them, via the orifice $\mathbf{93}_2$ and the duct $\mathbf{94}_2$.

The shape of the front face 91*a* and the shape of the surface 93*i* are substantially complementary so as to minimize the amount of coating fluid residue when the piston 91 reaches the end of its stroke in the vicinity of the end wall 93, thus making it possible to limit the amount of cleaning fluid that is consumed.

An outer jacket 99 is mounted around the jacket 92 inside the body 95 and serves to limit the volume $V'_9$ opposite from the end wall 93. The end wall 99*a* of this outer jacket is pierced by an opening 99*b* for passing the rod of a not shown actuator that controls the position of the piston 91 within the housing $L_9$.

Reference $e_{96}$ denotes the thickness of the wall 96 over the major portion of its height, i.e. in its portion situated above the piston ring 98 closest to the face 91*a* when the piston 91 is in the vicinity of the end wall 93. Reference $e'_{96}$ denotes the thickness of the wall 96 in the vicinity of the end wall 93. The thickness $e'_{96}$ has a value greater than the thickness $e_{96}$ In practice, $e'_{96}$ is at least 1.5 times and preferably twice as great as $e_{96}$. The thickness $e_{93}$ of the end wall 93 has a value close to that to the thickness $e'_{96}$. Thus, the jacket 92 presents good stiffness in its zone defining the volume V9 when the piston is close to the end of its stroke at the end of a spraying operation, such that the jacket 92 can withstand injection of the cleaning fluid under pressure into this volume.

Given the difference between the thicknesses $e_{96}$ and $e'_{96}$, a shoulder 96*a* is formed in the outside of the wall 96. This shoulder receives the edge 99*c* of the outer jacket 99 remote from its end wall 99*a* bearing thereagainst. The jacket 92 and the outer jacket 99 thus form an assembly that can be held in place reliably inside the bore provided for this purpose in the body 95.

In a variant of the invention which is not shown, the thickness of the wall 96 may be constant over its entire height. No shoulder is provided in the outside of this wall, the jacket 92 then bearing via the edge of the wall 96 remote from the end wall 93 against the end wall 99*a* of the outer jacket 99.

When it is appropriate to extract the piston 91 from the housing $L_9$, the assembly 8 is separated from the plate 7 and the jackets 92 and 99 are extracted from the body 95. The outer jacket 99 is then withdrawn, after which an appliance 100 is mounted on the jacket 92 in the vicinity of its opening $0_{92}$ through which the piston 91 can be put into place in the housing $L_9$. The appliance 100 comprises a one-piece body 101 constituted by an end wall 102 and by a skirt 103 defining an inside volume $V_{101}$ that is in communication with the volume $V'_9$ and the housing $L_9$ when the appliance 100 is mounted on the jacket 92. The skirt 102 is provided with an internal groove 104 having an O-ring 105 received therein, thus enabling the body 101 to be mounted in leaktight manner on the jacket 92.

A suction device 106 of the Venturi effect type is integrated in the end wall 102 and comprises an injection nozzle 107 and an exhaust nozzle 108, the downstream end 107*a* of the nozzle 107 being provided with an internal constriction 107*b* and being disposed immediately upstream from the inlet zone 108*a* of the nozzle 108. The end 107*a* is received in a housing 109 formed in the end wall 108 and in communication with the volume 101.

Figure 3:
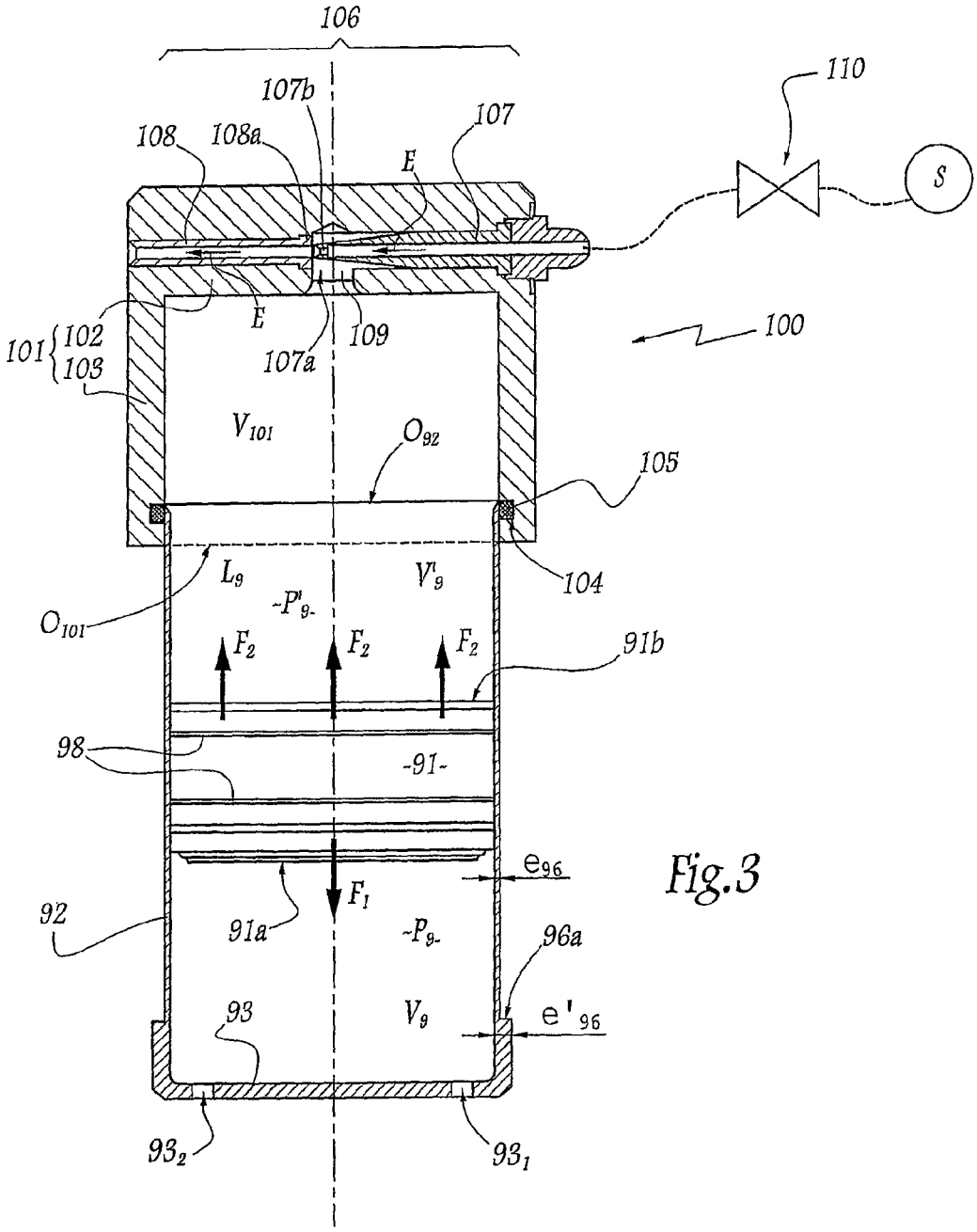
FIG. 3 is a fragmentary diagrammatic section of some of the equipment shown in FIG. 2, during a maintenance operation, said equipment being equipped with a removal appliance.

The nozzle 107 is connected to a source S of compressed air and the flow of air, as represented by arrow E in FIG. 3, is controlled by a valve 110.

By means of the Venturi effect in the housing 109, the flow of air E creates a vacuum pressure that propagates into the volume 101 and into the volume $V'_9$, thereby exerting a suction force on the piston 91 due to the difference in pressures acting respectively on the faces 91*a* and 91*b*, this force being represented by arrows $F_2$ and distributed over the face 91*b* of the piston 91. Thus, the fact of causing air to flow in the device 106 enables a pressure difference ΔP to be established between the pressure $P_9$ that exists in the volume $V_9$ and the pressure $P'_9$ that exists in the volume $V'_9$, this difference being positive, as represented by the following equation:

$$\Delta P = P_9 - P'_9 > 0$$

This pressure difference has the effect of causing the piston 91 to rise progressively towards the opening $0_{92}$, driven by the force $F_2$.

The internal dimensions of the skirt 103 are selected to be slightly greater than those of the jacket 92. In other words, the opening $0_{101}$ of the internal volume $V_{101}$ is larger, in directions perpendicular to the axis $X_9$, than the jacket 92 and the piston 91, thus enabling the piston 91 to be moved to the inside of the volume $V_{101}$, thus enabling the piston 91 to be withdrawn completely from the housing $L_9$.

The only face of the piston that is likely to strike a stationary portion during piston withdrawal is its rear face 91*b*. In particular, the front face 91*a* of the piston, of a shape that needs to be matched accurately to that of the end wall 93 of the jacket 92, does not run any risk of being damaged during withdrawal of the piston.

In practice, the body 101 is mounted by hand on the jacket 92 in the vicinity of its opening $0_{92}$ and is fastened thereon by force, with the O-ring 105 providing sealing.

In a variant of the invention that is not shown, the body 101 could also be mounted in sealed manner on the body 95.

As shown diagrammatically in FIG. 1, the appliance 100 may be kept in the immediate vicinity of the installation I while it is in operation, e.g. in a box 300 mounted on a partition 14 defining a spray zone. The appliance is thus ready for use.

Figure 4:
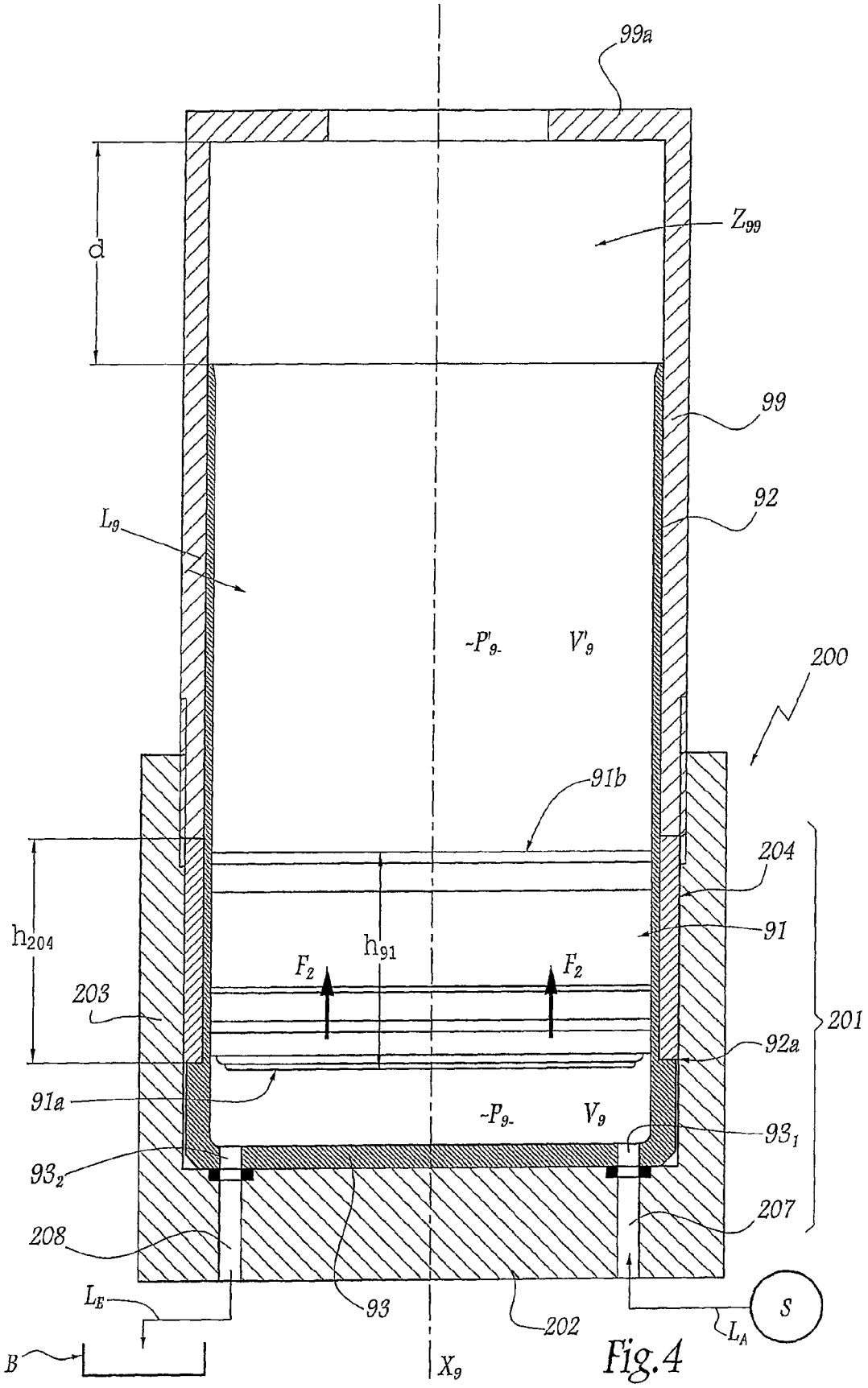
FIG. 4 is a section analogous to FIG. 3 during a maintenance operation using a different removal appliance.

In a variant shown in FIG. 4, the piston can also be withdrawn from the jacket by means of another appliance 200 receiving the jacket 92. The jacket 92 is raised together with its piston 91 into a central bore of a body 201 that includes an end wall 202 and a skirt 203 surrounding the bore. A duct 207 is formed in the end wall 202 and is connected by a feed line $L_A$ to a source S of water under pressure. A duct 208 is also formed in the end wall 202, which duct 208 is connected via an exhaust line $L_E$ to a discharge vessel B. The ducts 207 and 208 are in alignment with two respective orifices $93_1$ and $93_2$ formed through the end wall 93 of the jacket 92 when it is in place in the body 201.

As before, the piston 91 that slides inside the housing $L_9$ constituted by the jacket 92 separates in leaktight manner a volume $V_9$ that is defined between its front face 91*a* and the end wall 93, from a volume $V'_9$ bordered by the rear face 91*b* of the piston and extending above it in the view of FIG. 4.

When the jacket 92 is in place in the body 201, the outer jacket 99 is initially removed, and then a ring 204 is placed around the jacket 92, so as to bear against an outer peripheral shoulder 92*a* of the jacket 92 against which the outer jacket 99 normally comes to bear. The outer jacket 99 is then put back into place around the jacket 92, thus being offset from its configuration in which the reservoir 9 is used for storing the coating fluid. The outer jacket 99 is offset by a distance d that is equal to the height $h_{204}$ of the ring 204 measured parallel to the axis $X_9$. In practice, this height $h_{204}$ is selected to be greater than or equal to the height $h_{91}$ of the piston 91, i.e. to the distance between its front and rear faces 91*a* and 91*b*. $h_{204}$ is preferably about 1.2 times $h_{91}$.

Because of the duct 207, it is possible to inject water under a pressure of a few bars into the volume $V_9$, thus having the effect of increasing the pressure $P_9$ in the volume $V_9$ up to a value that is greater than the pressure $P'_9$ in the volume $V'_9$, where the pressure $P'_9$ is substantially equal to atmospheric pressure.

The difference between the pressures $P_9$ and $P'_9$ that act respectively on the front and rear faces 91*a* and 91*b* of the piston 91 results in a force $F_2$ that is distributed around the axis $X_9$ and that has the effect of moving the piston 91 away from the end wall 93.

Since the outer jacket 99 is offset through the distance d, as described above, a zone $Z_{99}$ is created in the vicinity of its end wall 99*a* in which the piston can be received after it has traveled along the full height of the jacket 92, said zone $Z_{99}$ being situated outside the housing $L_9$. The piston 91 can then easily be recovered by withdrawing the outer jacket 99.

The fluid coming from the source S is not necessarily water. It could be some other liquid or it could be a gas, in particular air under pressure.

In a variant that is not shown, it is possible to use air instead of water in the appliance 200. Under such circumstances, a calibrated vent is advantageously provided for the end wall 99*a* so as to brake the upward movement of the piston 91.

The invention is applicable independently of the specific type of sprayer 10, which may be or not electrostatic, rotary or pneumatic.

The invention is shown with an appliance having a suction device of the Venturi effect type. Nevertheless, it is applicable to a suction device of some other type, in particular an appliance in which the internal volume $V_{101}$ is connected to an external vacuum source, e.g. of the vacuum pump type.

The invention is shown with a sprayer device having its reservoir mounted on the moving portion of a multi-axis robot type automaton. Nevertheless, the invention is applicable to a device having the reservoir with its piston stationary and connected to a sprayer via a flexible hose making it possible, where appropriate, for the sprayer to move relative to the reservoir.

The invention is shown with a piston that is controlled by an actuator, however the invention applies equally well to a piston that is controlled pneumatically.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A device for spraying a coating fluid, the device comprising a sprayer and a reservoir for feeding said sprayer with fluid, said reservoir comprising a body and defining a cylindrical housing in which there slides a piston forming a moving wall for a storage volume for storing the coating fluid, said housing being defined by a jacket received in said body that forms a support for said jacket, the device being characterized in that said jacket is provided with an end wall cooperating with the peripheral wall of said jacket and said piston to define said storage volume wherein said piston is in sliding contact with a peripheral wall of said jacket and wherein said jacket is provided with an end wall cooperating with said peripheral wall of said jacket and said piston in order to define said storage volume between said piston, said peripheral wall and said end wall and wherein said peripheral wall has a first thickness over the major fraction of its length taken parallel to the direction ($X_9$) in which said piston moves, and a second thickness in the vicinity of said end wall, said second thickness having a value that is greater than said first thickness.

2. A device according to claim 1, characterized in that said end wall is pierced by at least one orifice for passing the coating fluid and/or a cleaning fluid.

3. A device according to claim 1, characterized in that said body is provided with at least one duct for passing coating fluid and/or cleaning fluid, and opening out into register through an orifice passing through said end wall.

4. A device according to claim 1, characterized in that it includes an outer jacket surrounding said jacket radially.

5. A device according to claim 4, characterized in that said outer jacket is provided with an end wall in which a passage is formed for passing means for controlling the position of said piston in said housing.

6. A device according to claim 4, characterized in that said jacket is provided with an outer peripheral shoulder for bearing against an edge of said outer jacket.

7. A device according to claim 1, characterized in that said moving wall formed by said piston and the inside surface of said end wall are substantially complementary.

8. An installation for spraying a coating fluid, the installation including at least one device according to claim 1.

9. An installation according to claim 8, characterized in that it also includes at least one appliance for removing said piston in place in said housing, said appliance comprising means enabling a pressure difference ($\Delta P$) to be generated between the pressures that exist respectively in said coating fluid storage volume and in another volume formed in said housing and separated from said storage volume by said piston, said pressure difference being such that the pressure that exists in said storage volume is greater than the pressure that exists in the other volume, when there is no fluid to be stored in said volumes.

10. An installation according to claim 9, characterized in that said appliance comprises:

a body suitable for being fitted in leaktight manner on the jacket or on an element secured to said jacket, said body defining an open volume suitable for being put into communication with said housing; and a suction device suitable for creating relative vacuum pressure in said volume, when said body is fitted onto said jacket or said element.

11. An installation according to claim 10, characterized in that said body is blind, and in that said suction device is of the Venturi effect type and is integrated in the end wall of said body.

12. An installation according to claim 9, characterized in that said appliance includes means suitable for injecting a fluid other than the fluid to be stored, under a pressure greater than atmospheric pressure, into said volume for storing the coating fluid.

* * * * *